United States Patent [19]

Pavlick

[11] Patent Number: 5,074,725

[45] Date of Patent: Dec. 24, 1991

[54] WELL CAR TRAILER ADAPTOR

[75] Inventor: Michael J. Pavlick, Blue Bell, Pa.

[73] Assignee: Transit America, Inc., Philadelphia, Pa.

[21] Appl. No.: 630,847

[22] Filed: Dec. 20, 1990

[51] Int. Cl.[5] ..... B61D 17/10

[52] U.S. Cl. ..... 410/54; 410/28.1; 410/20; 105/375

[58] Field of Search ..... 105/355, 370, 371, 375, 105/404; 410/3, 4, 7, 9, 10, 11, 16, 19, 20, 21, 28.1, 46, 54, 56, 66; 108/55.1

[56] References Cited

U.S. PATENT DOCUMENTS

| | | | |
|---|---|---|---|
| 2,489,024 | 11/1949 | Gaynor | 410/54 X |
| 3,357,371 | 12/1967 | Gutridge | 410/54 |
| 3,976,013 | 8/1976 | Woodford | 108/55.1 X |
| 4,132,323 | 1/1979 | Simmons | 410/3 X |
| 4,347,794 | 9/1982 | Nordström | 108/55.1 X |
| 4,456,413 | 6/1984 | Pavlick | 410/4 X |
| 4,786,223 | 11/1988 | Crissy et al. | 410/10 X |
| 4,986,705 | 1/1991 | Durkin | 410/46 X |
| 5,001,990 | 3/1991 | Pavlick | 105/375 |
| 5,011,347 | 4/1991 | Bullock | 410/20 X |

*Primary Examiner*—Margaret A. Focarino
*Assistant Examiner*—Joseph D. Pape
*Attorney, Agent, or Firm*—Walter B. Udell

[57] ABSTRACT

A quickly installable and removable integral lightweight floor structure trailer adaptor for railroad well cars for converting the well car from one for use with containers to one for carrying trailers, including a plurality of substantially equal height parallel disposed lightweight beams having substantially coplaner upper surfaces fixedly interconnected to form a rigid platform for the wheels of a trailer, the height of the beams being such as to raise the underside of a trailer to an elevation above the well car sidewalls a sufficient distance to provide withdrawal clearance for the loading arms of a trailer loading crane when the trailer with the adaptor carried thereby is loaded into the well car, and quick detachable coupling means securing the adaptor to the wheels of a trailer bogie with the tires seated on the adaptor to effectively restrain movement of the adaptor relative to the trailer wheels. The adpator beams are of sufficient length to fit between and span the distance between the well car sidewalls and are of sufficient height to elevate a fully downwardly extended trailer landing gear above the normal floor plane of the well car when the trailer is seated in the well. Also provided are structures for longitudinal and lateral positioning of the adaptor relative to the rear wheels of a trailer bogie.

16 Claims, 4 Drawing Sheets

WELL CAR TRAILER ADAPTOR

This invention relates generally to railroad well cars of the type which are used for carrying double-stacked containers. When these cars were developed for railroad use, and for some time thereafter, they were built with wells for accommodating 40 foot long containers. There are more than two thousand such units presently in service on American railroads. At the present time the tendency in the container industry is to increase container lengths to 45 feet, 48 feet and even to 53 feet. The 40 foot well cars will become increasingly obsolete as more of these oversized containers come into use, and it may become difficult to find 40 foot loads for such cars in some markets, forcing the cars to operate partially empty. The present invention makes it possible to load these empty well cars with trailers. The trailers can be at least 45 feet in length, and in some cases even 48 feet because a part of the trailer overhangs the well car deck beyond the well location. The present invention provides apparatus for adapting the 40 foot well cars for trailer carrying use without degrading its double stacked container capability, and is an improvement over my invention shown and described in my copending allowed application Ser. No. 07/409,312 now U.S. Pat. No. 5,001,990.

The adaptation of the 40 foot well cars to trailer use involves two components. One component is a trailer hitch head and mounting pedestal that can be attached to the end deck of the well car for securing the trailer kingpin onto the carmounted hitch head. While the hitch head could be made demountable, since it weighs only on the order of 500 pounds, it can be fixedly mounted on the car deck as a permanent structural part of the car without measurably reducing the load carrying capabilities of the well car. The second component of the adaptation is a lightweight unitary aluminum floor trailer adaptor which supports the trailer bogie by bridging between the lower side sills of the well car and transferring the vertical load of the trailer to the car sidewalls by bearing on the inward turned flange portion of the side sill, as will be shown subsequently.

The trailers cannot be directly placed into the standard well cars without an auxiliary floor structure because the normal floor structure of the well cars when used for carrying containers is substantially completely open and provides no points of support for the trailer wheels. A permanently installed flooring section would be exceedingly heavy, on the order of perhaps 5,000 pounds, if it were to be vertically thin enough to avoid unduly raising the height of double stacked containers. Double-stacked containers at the present time can rise 17 feet to 19 feet above the well car support sills, and raising the height substantially further could create severe problems in permitting double-stacked passage through some railroad tunnels, but more importantly it would severely reduce the load carrying capability of the well cars.

The trailer adaptor apparatus according to the invention, by consisting of a unitary rigid floor structure only present at the support points for the trailer bogie, and not throughout the length of the car, can be made sufficiently vertically high to provide excellent strength while not raising the trailer to an excessive height. A floor structure on the order of one foot in height will raise the top of a carried trailer only to about 15½ feet, still substantially below the double-stacked container height. The floor structure of the trailer adaptor adds only approximately 750 pounds in weight, rather than the 5,000 pounds of a permanent type floor.

Moreover, the one foot adaptor height permits the trailer to be loaded onto the well car with the trailer landing gear in fully downwardly extended position instead of having to retract the landing gear. This permits the trailer not only to be loaded, but also to be unloaded at a siding in less than half of the time it would take to load and unload if the landing gear had to be raised and lowered. Finally, the height of the well car side walls is such that if the trailer were attempted to be loaded directly into the well with the bogie wheels substantially at the container floor level, the arms of the loading crane would be jammed on the car sidewalls top rails and could not release the trailer. The height of the adaptor stops the vertical descent of the trailer at a point where there is adequate clearance for the crane loading arms to release the trailer after depositing it into the well car.

The trailer adaptor according to the invention is an improvement over the multiple discrete floor beams structure disclosed and claimed in my aforesaid copending application because it is a unitary structure which does not require two men to install it into and remove it from the well car, as is the case with the plural floor beams structure. It only requires one ground man to secure the adaptor to the trailer bogie after the trailer has been properly positioned on the adaptor by a piggybacker, and to subsequently detach the adaptor from the trailer when the latter has been removed from the well car. The actual placing of the adaptor into the well car and removal of it therefrom is carried out by the trailer handling piggybacker simultaneously with the loading and unloading of the trailer with respect to the well car because the adaptor is detachably secured to the trailer bogie, as will appear more clearly hereinafter. The adaptor according to the invention reduces trailer loading and unloading times, well car conversion time for converting between containers and trailers usage, and manpower required to effect such conversions.

A primary object of the invention is to provide a novel unitary railroad well car trailer adaptor which is quickly and easily attachable to and detachable from a trailer bogie to convert the well car to carry trailers with the attached adaptor, and to carry double-stacked containers when the adaptor is not used.

Another object of the invention is to provide a novel railroad well car unitary trailer adaptor as aforesaid which is light in weight and relatively inexpensive, while having a very high strength to weight ratio.

A further object of the invention is to provide a novel railroad well car trailer adaptor as aforesaid which includes means for quick detachably securing the adaptor to the trailer bogie to prevent walking or creeping movement relative to the railroad car.

The foregoing and other objects of the invention will become clear from a reading of the following specification in conjunction with an examination of the appended drawings, wherein.

In the several figures, like elements are denoted by like reference characters.

Figure 2:
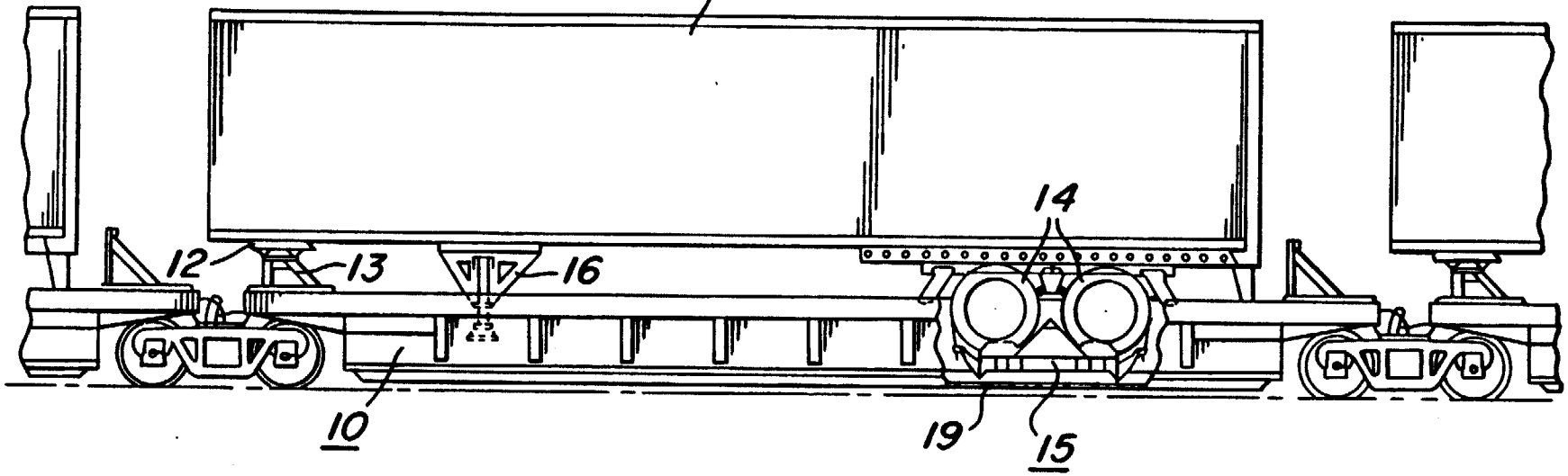
FIG. 2 is a side elevational view showing generally the installation of a trailer in a well car utilizing the invention with a portion of the car side wall broken away to show the adaptor.
Figure 3:
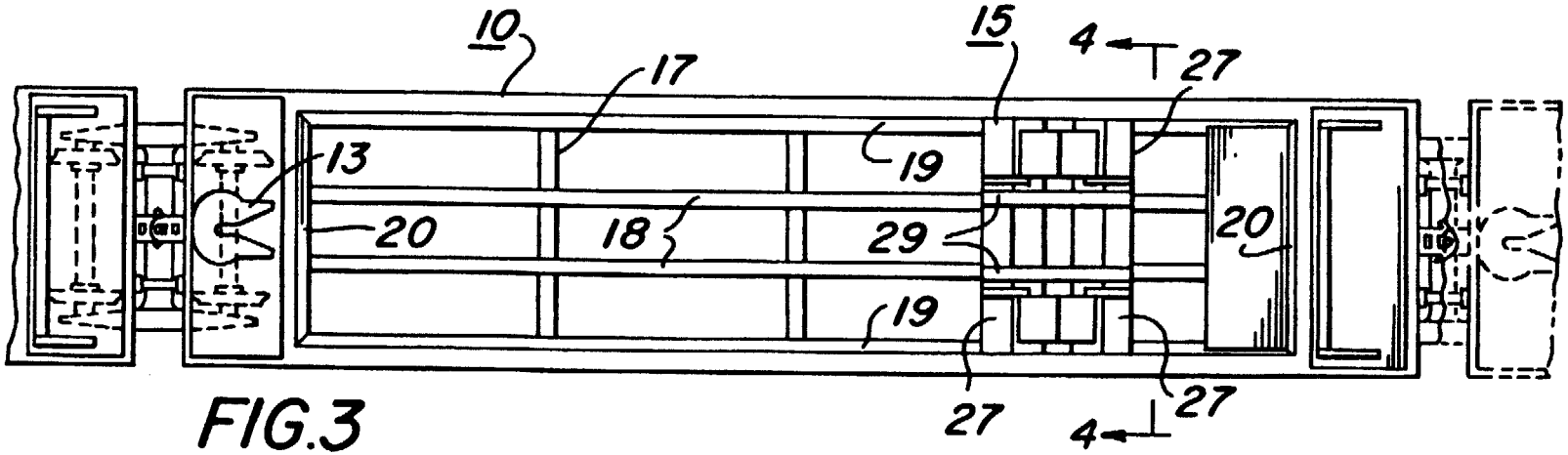
FIG. 3 is a plan view showing the railroad well car and the well car trailer adaptor according to the invention positioned in the well car over the openwork bottom of the car.

Turning now to an examination of the drawings, and considering first FIG. 2, there is seen a railroad well car designated generally as 10 into which is seated a trailer 11 having its kingpin 12 securely engaged with hitch head 13 mounted on the end deck of the railroad car 10. The trailer bogie is shown with the trailer wheels 14 shown seated on the trailer adaptor 15 according to the invention. The trailer landing gear 16 is shown in its fully extended position clear of the underlying well car floor structure. The open gridwork bottom structure of the well car 10 is best seen in the showing of FIG. 3 as the transversely extending cross members 17 and longitudinally extending members 18, these members being relatively widely spaced and welded to one another and to the rail car bottom side sills 19 and end sills 20. It is clear from the showing of FIG. 3 that without the adaptor 15 according to the invention, the trailer wheels would have no support from the normal well car floor structure.

Figure 1:
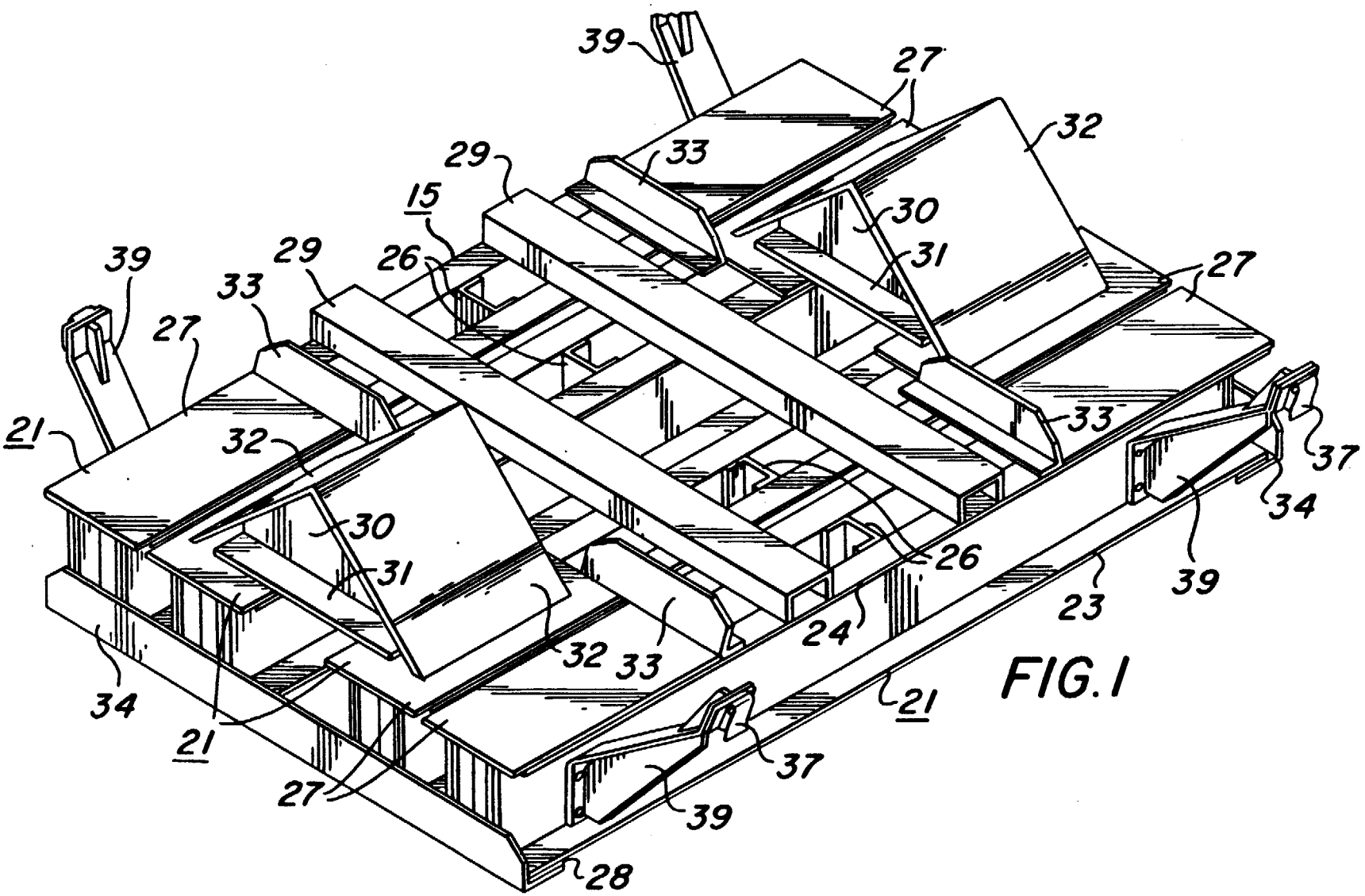
FIG. 1 is an isometric view of the well car trailer adaptor according to the invention as would be seen when viewed from one end and above.
Figure 4:
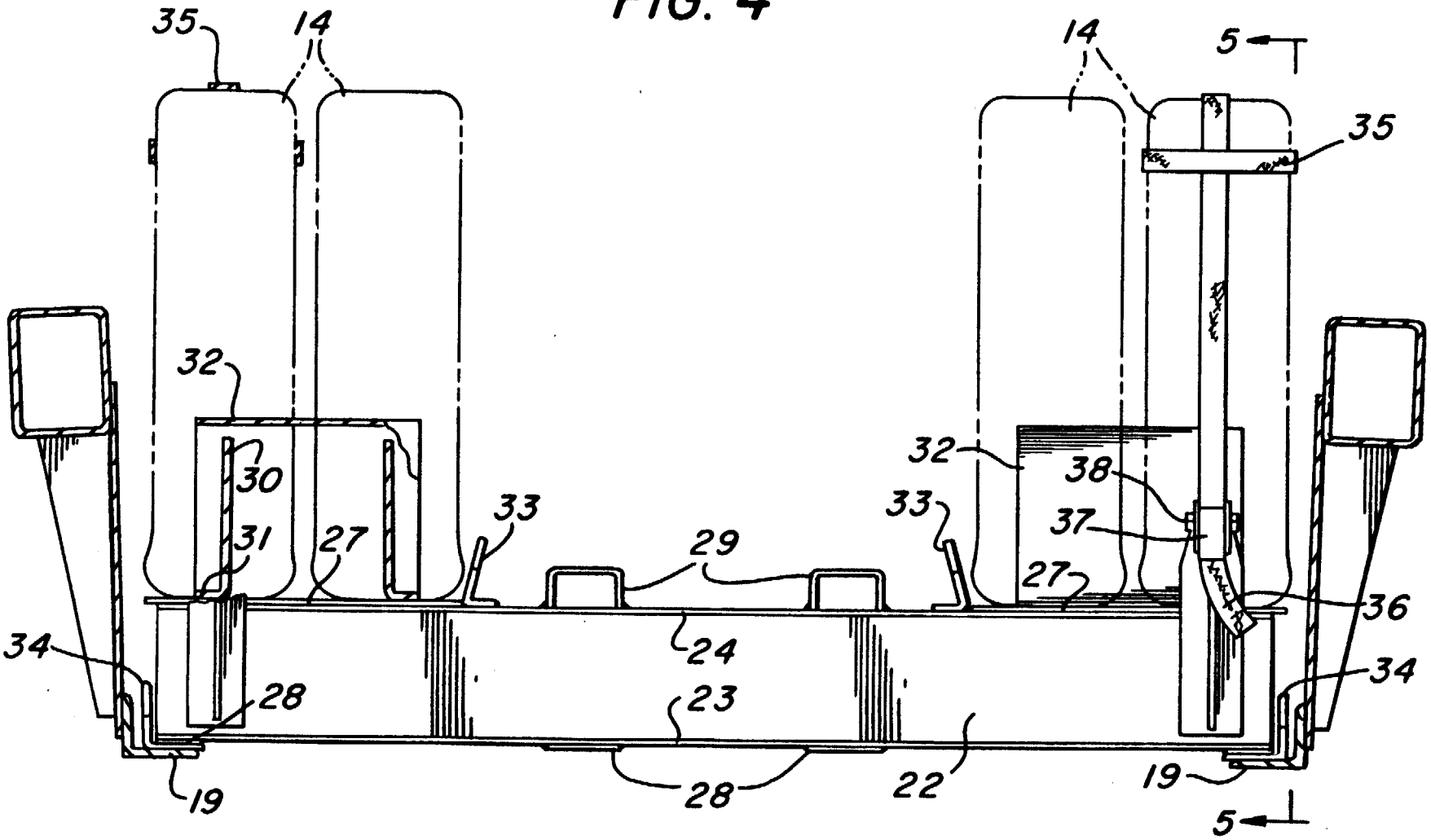
FIG. 4 is a vertical cross section through the well car showing the trailer adaptor according to the invention as would be seen when viewed along the lines 4—4 shown on FIG. 3, with a set of trailer wheels shown in phantom.
Figure 5:
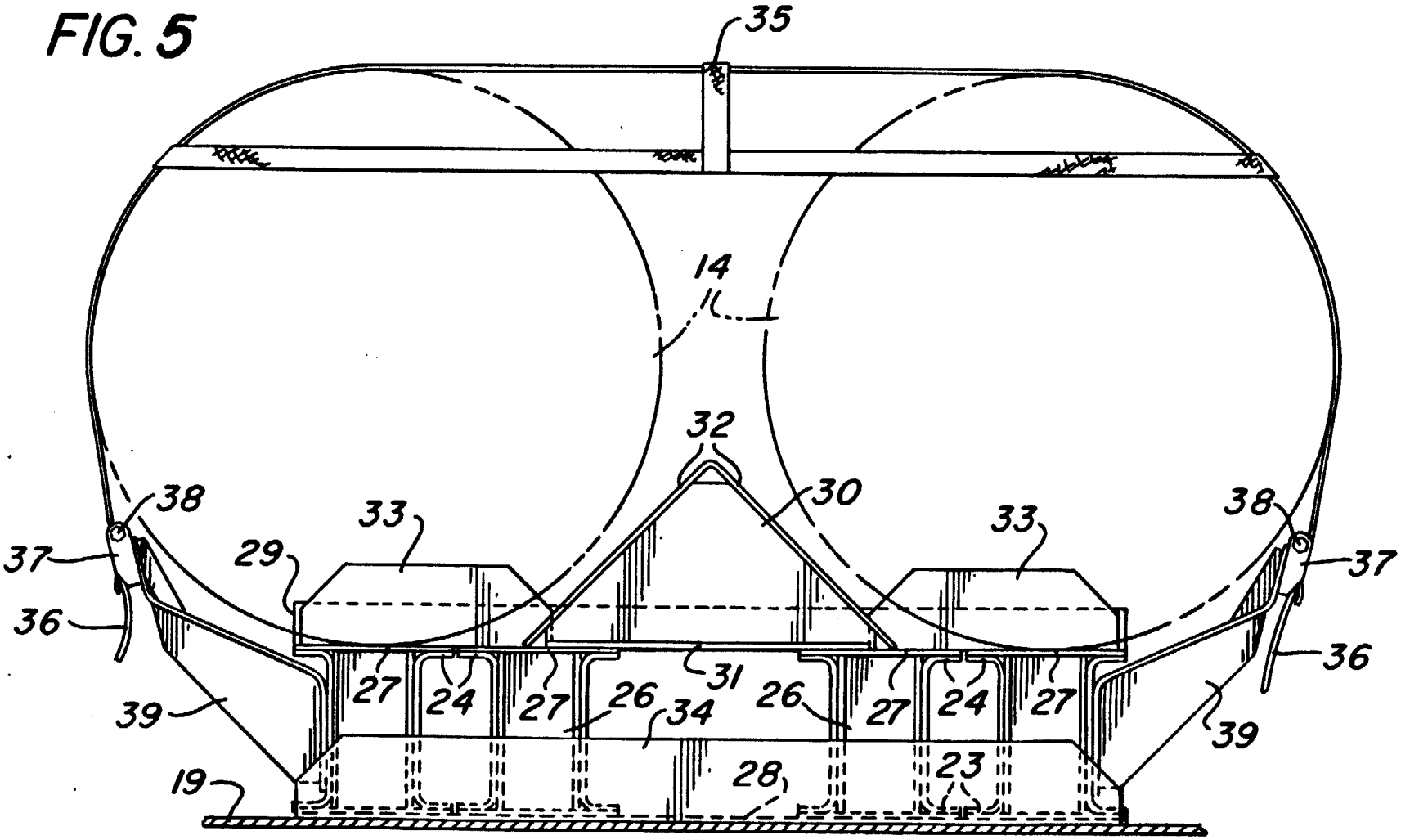
FIG. 5 is a side view of the trailer adaptor according to the invention as would be seen when viewed along the lines 5—5 shown on FIG. 4.

As best seen in FIGS. 1, 4 and 5, the trailer adaptor 15 includes four beams 21 arranged in two spaced apart side by side parallel pairs, the beams of each pair being closely parallel spaced with a space between the beams pairs of slightly more than one beam width. Each beam includes a pair of channel members 22 oriented with channel base walls vertical and having the flanges 23 disposed horizontally at the lower ends of the beams and the flanges 24 disposed horizontally at the upper ends of the beams. As best seen in FIGS. 3 and 4 these beams 21 run substantially from side to side of the well car between the well car side walls. The two channel members 20 of each of the beams 21 are spaced apart and rigidly secured together by vertical channel sections 26, the upper flanges 24 of the channel members 22 having rigidly affixed thereto, as by welding or bolting, the top plates 27 immediately inward from each end of each beam 21. The lower flanges 23 of the channel members 22 of all four beams 21 are rigidly secured together by bottom bars or straps 28, while the upper flanges 24 of all four beams are rigidly secured together by the transversely extending channels 29 welded or otherwise secured thereto.

The spaced apart inner beams are also secured together at their top plates 27 by the triangular wheels anti-roll positioning structures formed by triangular vertical plates 30 having horizontal bottom flanges 31, and sloping plates 32. The tops of the outer and inner beams of each pair of the aforenoted two spaced apart pairs of beams are fixedly connected by angled lateral tires buffer plates 33. The trailer wheels anti-roll structure in functional operative relationship to the trailer wheels is best seen in FIGS. 2 and 5, while the relationship of the tires buffer plates is best seen in FIG. 4. The entire structure is further integrated and rigidified by the reinforcing angles 34 affixed to the beams bottom bars 28.

The trailer adaptor is secured to the trailer wheels by means of strap harnesses 35 having strap webs which cap the tires, and securement strap tails 36 which feed through ratchet cinchers 37 and are tightened by rotation of the cinchers hex head cylinders 38. The cinchers 37 are fixed to the upper ends of brackets 39, the lower ends of which latter are fixed to the outer faces of the outer beams 21 proximate their ends.

In use, the trailer adaptor is placed on the ground and a trailer to be loaded is driven alongside of or longitudinally aligned with the adaptor and next to the well car into which it is to be loaded. The trailer, with its landing gear down, is then disconnected from the tractor and the latter is driven away. The piggybacker then picks up the trailer and deposits it with its wheels positioned on the adaptor as shown in the drawings. The ground man then places the strap harness 35 over the tires, as shown, and secures the adaptor to the wheels by projecting the strap tails 36 through the cinchers 37 and tightening the straps. The piggybacker then picks up the trailer with the adaptor as a unit and deposits it into the well car, as best seen in FIG. 2. At the end of the trip the procedure is reversed.

Typically, although not necessarily, the adaptor beams 21 could be constructed using channels 22 which are 11½ inches high having 3 inch flanges and being ¼ inch thick, while being on the order of 8 feet long. The top plates 27 and bottom plates 28 could typically be of ¼ thick stock. The vertical channel sections 26 could be of 6 inch channel width having 3 inch flanges and also being ¼ inch thick.

Having now described the invention in connection with a particularly illustrated embodiment thereof, modifications and variations of the invention may now naturally occur to those persons normally skilled in the art without departing from the essential scope or spirit of the invention, and accordingly it is intended to claim the same broadly as well as specifically as indicated by the appended claims.

What is claimed is:

1. A quickly installable and removable integral lightweight floor structure trailer adaptor for use for railroad well cars having sidewalls for converting the well car from one for use with containers to one for carrying trailers, comprising in combination, a plurality of substantially equal height parallel disposed lightweight beams having substantially co-planer upper surfaces fixedly interconnected to form a rigid platform for the wheels of a trailer, the height of said beams being such as to raise the underside of a trailer to an elevation above the well car sidewalls a sufficient distance to provide withdrawal clearance for the loading arms of a trailer loading crane when the trailer with the adaptor carried thereby is loaded into the well car, and coupling means for quick detachably securing said adaptor to the wheels of a trailer bogie with the tires seated on the adaptor, said coupling means being effective to restrain movement of said adaptor relative to the trailer wheels, said adaptor beams being of sufficient length to fit between and span the distance between the well car sidewalls and being of sufficient height to elevate a fully downwardly extended trailer landing gear above the normal floor plane of the well car when the trailer is seated in the well.

2. A trailer adaptor as set forth in claim 1 further including at least one trailer wheels anti-roll positioning structure fixed to and extending upward from the said upper surface of at least one of said beams, said at least one anti-roll positioning structure being so positioned as to be readily disposed between the front and rear wheels of a trailer bogie to longitudinally position the trailer bogie relative thereto when said trailer adaptor is secured to the wheels of a trailer bogie as aforesaid.

3. A trailer adaptor as set forth in claim 1 further including lateral tires positioning means fixed to and extending upward from the said upper surface of at least one of said beams; said positioning means being so positioned as to substantially laterally center the trailer adaptor relative to the trailer bogie wheels when said trailer adaptor is secured to the wheels of a trailer bogie as aforesaid.

4. A trailer adaptor as set forth in claim 1 further including at least one trailer wheels anti-roll positioning structure fixed to and extending upward from the said upper surface of at least one of said beams, said at least one anti-roll positioning structure being so positioned as to be readily disposed between the front and rear wheels of a trailer bogie to longitudinally position the trailer bogie relative thereto when said trailer adaptor is secured to the wheels of a trailer bogie as aforesaid, and, further including lateral tires positioning means fixed to and extending upward from the said upper surface of at least one of said beams; said positioning means being so positioned as to substantially laterally center the trailer adaptor relative to the trailer bogie wheels when said trailer adaptor is secured to the wheels of a trailer bogie as aforesaid.

5. A trailer adaptor as set forth in claim 1 wherein said coupling means comprises strap harness means adapted to cap the tires of the trailer wheels, and strap harness cinching means secured to said adaptor beams effective to tighten said harness and closely secure said adaptor to the trailer wheels.

6. A trailer adaptor as set forth in claim 1 wherein said plurality of beams are arranged in two spaced apart side by side parallel pairs, the beams of each said pair being closely spaced to one another, with a space between said beams pairs on the order of one beam width.

7. A trailer adaptor as set forth in claim 1 wherein each said beam comprises, a) a pair of parallel longitudinally extending horizontally spaced members slightly shorter in length than the width of the well car in which the adaptor is to be placed, said members having upper and lower edges, b) a plurality of spacers positioned between and each rigidly secured to both of said members between the said upper and lower edges of the latter, c) a pair of top plates rigidly secured to the upper edges of said pair of members and each extending inward respectively from one of the opposite ends of said beam for a sufficient distance to support thereon the wheels of a trailer.

8. A trailer adaptor as set forth in claim 7 further including a plurality of bottom straps rigidly secured to the lower edges of all said beams to intersecure the same.

9. A trailer adaptor as set forth in claim 7 wherein said parallel longitudinally extending horizontally spaced members are channel members, and the said upper and lower edges thereof are the channel flanges.

10. A trailer adaptor as set forth in claim 7 wherein said parallel longitudinally extending horizontally spaced members are channel members, and the said upper and lower edges thereof are the channel flanges, and wherein said spacers are channel sections oriented so that the lengthwise direction of said spacers channel sections is vertical with the spacer channel sections opposite flanges rigidly secured to different ones of said channel members.

11. A trailer adaptor as set forth in claim 2 wherein said anti-roll positioning structure bridges between and extends upward from a pair of said beams and is of triangular shape.

12. A trailer adaptor as set forth in claim 3 wherein said lateral tires positioning means comprises a plurality of angled lateral buffer plates fixed to and extending upward from a plurality of said beams.

13. A trailer adaptor as set forth in claim 4 wherein said anti-roll positioning structure bridges between and extends upward from a pair of said beams and is of triangular shape.

14. A trailer adaptor as set forth in claim 4 wherein said lateral tires positioning means comprises a plurality of angled lateral buffer plates fixed to and extending upward from a plurality of said beams.

15. A trailer adaptor as set forth in claim 4 wherein said anti-roll positioning structure bridges between and extends upward from a pair of said beams and is of traingular shape, and, wherein said lateral tires positioning means comprises a plurality of angled lateral buffer plates fixed to and extending upward from a plurality of said beams.

16. A trailer adaptor as set forth in claim 6 wherein said anti-roll positioning structure bridges between and extends upward from the spaced apart proximate ones of said side by side parallel pairs of beams, and is of triangular shape.

* * * * *